United States Patent [19]

Iai

[11] 4,392,291

[45] Jul. 12, 1983

[54] METHOD FOR ASSEMBLING SLIDE FASTENER STRINGERS

[75] Inventor: Kenichiro Iai, Kurobe, Japan

[73] Assignee: Yoshida Kogyo K. K., Tokyo, Japan

[21] Appl. No.: 298,094

[22] Filed: Aug. 31, 1981

[30] Foreign Application Priority Data

Sep. 25, 1980 [JP] Japan ..... 55-133479

[51] Int. Cl.[3] ..... B21D 53/50; B29D 5/00

[52] U.S. Cl. ..... 29/408; 29/766

[58] Field of Search ..... 29/408, 409, 766, 767, 29/768

[56] References Cited

U.S. PATENT DOCUMENTS

| | | | |
|---|---|---|---|
| 3,947,946 | 4/1976 | Omori et al. | 29/408 |
| 4,237,604 | 12/1980 | Sawada et al. | 29/766 |
| 4,238,880 | 12/1980 | Takahashi | 29/766 |
| 4,292,733 | 10/1981 | Iimura | 29/766 |

*Primary Examiner*—Ervin M. Combs
*Assistant Examiner*—Steven E. Nichols
*Attorney, Agent or Firm*—Hill, Van Santen, Steadman, Chiara & Simpson

[57] ABSTRACT

Disclosed herein is method for assembling a pair of slide fastener stringers each having spaced sections in continuous rows of scoops and an apparatus for the same. The leading edge of the scoop row in the leading stringer is detected by a probe inserted into the guide groove of the binder member for the scoop row. The engagement of the leading edge and the claw of the probe retards the progress of the leading stringer thereby retarding the rotation of the feed roller for the leading stringer while increasing the speed of the rotation of the other feed roller for the trailing stringer, which is connected to the first feed roller through a differential transmission mechanism. After both of the stringers are brought into right alignment for exact engagement in the binder member, the claws disengage from the leading edges of the scoop row in the stringers and come out of the spaced sections. In this condition, the spaced sections in the stringers are detected individually by detecting lever means. Detector means detect the movement of the detecting levers and judge whether the proper inter-engagement of the stringers is obtained or not so that it produces either a signal to protrude the claw into the same spaced section following insertion of the detecting lever or a signal to stop operating the feed rollers.

7 Claims, 9 Drawing Figures

METHOD FOR ASSEMBLING SLIDE FASTENER STRINGERS

BACKGROUND OF THE INVENTION

1. Field of the Invention

The present invention relates to a method for assembling slide fastener stringers used in forming a slide fastener chain and an apparatus for the same, and more particularly to a method for assembling slide fastener stringers by engaging the corresponding engaging elements or scoops thereof while a pair of slide fastener stringers having spaced sections where there are no scoops in continuous rows of scoops are fed successively, and the apparatus for the same.

2. Description of the Prior Art

The U.S. Pat. No. 4,238,880 corresponding to a copending Japanese Application of the present Applicant (Public Disclosure No. 83552/79) discloses an assembling apparatus for slide fastener stringers wherein at the stage of feeding a pair of slide fastener stringers successively by a pair of feed rollers, respectively, when a proper feeding condition of the stringers relative to each other (or a condition in which the leading edge of the scoop row in one of the fastener stringers is in advance of (i.e. leads) the other by a half pitch of the scoop) is not obtained, the scoop rows come into right position of alignment without any shock to the leading scoop by means of cooperating probes for coming into contact with each of the leading edge of the scoop row to provide pulling force and a differential transmission mechanism for producing difference in rotation between the two rollers corresponding to the difference of the pulling force exerted by the probes, and then are guided to the engagement point in the binder member so that the right row of scoops and the left row of scoops are engaged with each other in properly aligned condition in the binder body.

In the above mentioned apparatus, high speed operation can be performed correctly if at the start of engagement of the stringers the leading edges of both scoops rows are properly aligned. Any misalignment of the right and left scoop rows can be detected and corrected, so they are put into the proper condition (refer to FIG. 9(A)) in high speed operation. However, when the number of scoops in one scoop row on one stringer is more or less than that of the other, as shown in FIGS. 9(B) or (C), or one or more scoops are removed from the scoop row (not shown), the above mentioned apparatus can not detect such defect which results in the possibility of production of faulty goods.

SUMMARY OF THE INVENTION

Therefore, the object of the present invention is to provide a reliable and efficient method for assembling slide fastener stringers which can overcome the problems of the conventional method and is capable of operating to produce proper fastener chains at high speed without overlooking the production of faulty goods and an apparatus for the same. Said method comprises engaging corresponding scoop rows of the slide fastener stringers with the leading edges of the scoop rows being aligned and then judging whether proper engagement is obtained by the successiveness in the scoop row or the alignment of trailing edges of scoop rows so that the apparatus continues to operate if the alignment is proper and stops operating if it is not proper, thereby avoiding producing defective goods and assembling the slide fastener stringers with high efficiency and accuracy. Said apparatus of the present invention is characterized by its structure which comprises a pair of laterally disposed feed rollers for feeding successively a pair of laterally disposed slide fastener stringers each having spaced sections where there are no scoops in continuous rows of scoops, a binder member fixedly positioned at the feeding side of said feed rollers for engaging said stringers with each other, a pair of laterally disposed claws for protruding into the spaced sections of the stringers and engaging with the leading edges of scoop rows directly following said spaced sections, a differential transmission mechanism for retarding the rotational velocity of one of said two feed rollers which feeds the leading stringer with which one of said two claws is engaged while accelerating the rotational velocity of the other roller until the leading edges of the scoop rows of said two stringers are aligned, said claws being adapted to come out from the spaced sections of the stringers when the leading edges of the scoop rows of the stringers are aligned in proper, characterized in that a pair of laterally disposed detecting levers are provided to protrude into the following spaced section of said stringer when they arrive and then to come out therefrom, and a detector is provided to detect the movement of the detecting lever so as to judge whether the engagement of the pair of stringers is proper and to produce either a signal to protrude the claw into the spaced section directly following the detecting lever in case the leading edges are properly aligned or a signal to stop operating the feed roller if they are not.

BRIEF DESCRIPTION OF THE DRAWINGS

In the Accompanying Drawings

DESCRIPTION OF THE PREFERRED EMBODIMENT

In the following, the apparatus of the present invention is illustrated by way of examples with reference to the drawings annexed.

Figure 1:
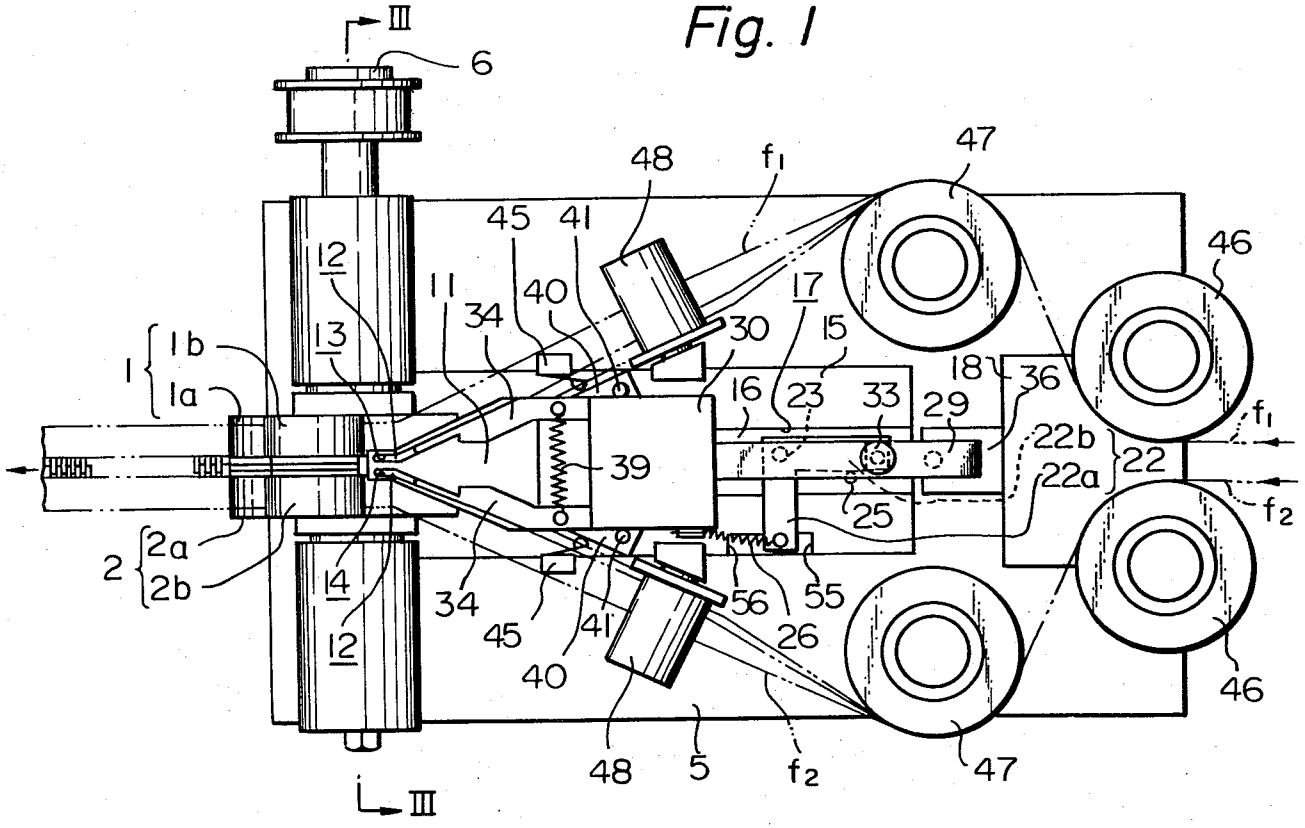
FIG. 1 is a plan view of a preferred embodiment of an apparatus for assembling slide fastener stringers in accordance with the present invention.
Figure 2:
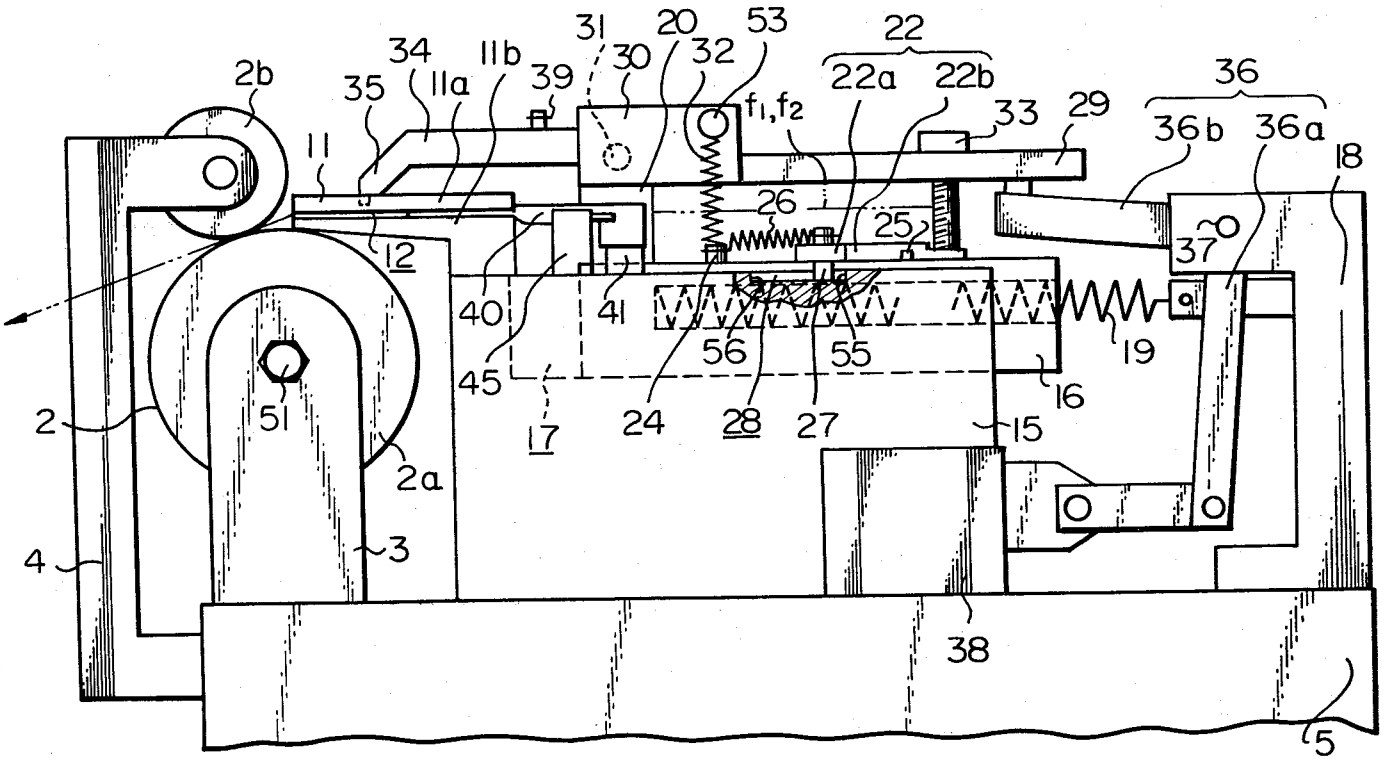
FIG. 2 is a front elevational view of the same apparatus shown in FIG. 1.
Figure 3:
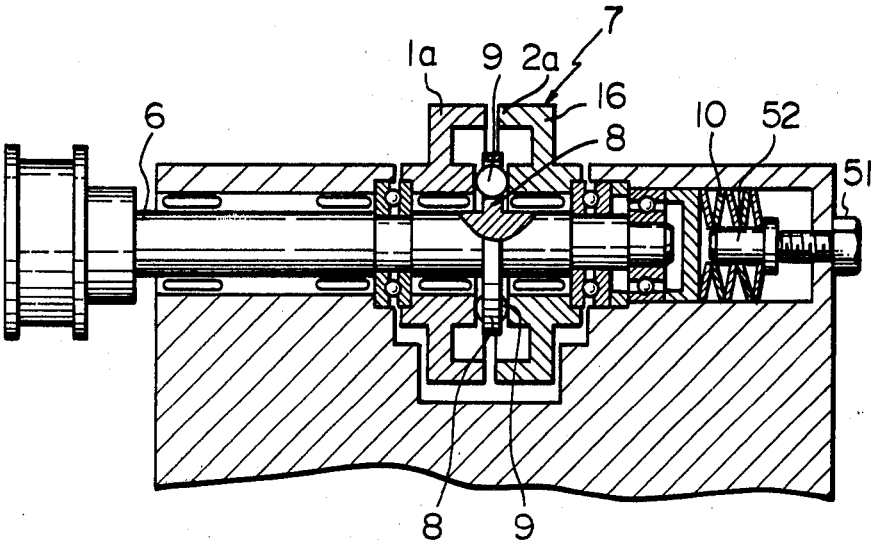
FIG. 3 is a cross-sectional view of the same apparatus along the line III—III in FIG. 1 showing the construction of the differential transmission mechanism.
Figure 4:
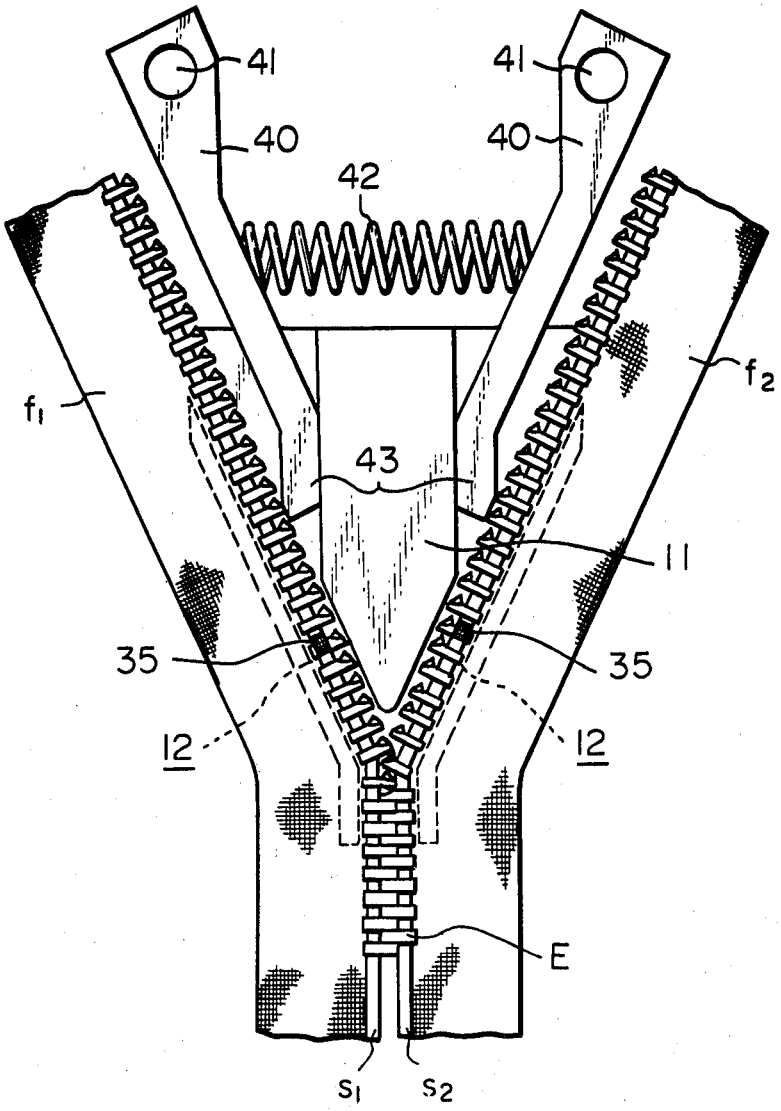
FIGS. 4–7 are similar plan views of part of FIG. 1 showing operative relation among the main components of the assembling apparatus.

In FIGS. 1–3, each of a pair of laterally disposed feed rollers 1 and 2 comprises an upper driven and a lower driving rollers 1*a*, 2*a* and 1*b*, 2*b* which contact each other. The driving rollers 1*a*, 2*a* are rotatably supported by supporting member 3 and the driven rollers 1*b*, 2*b* are supported by supporting member 4 on the base plate 5.

The structure of driving rollers 1*a*, 2*a* is illustrated in detail in FIG. 3, which is a cross sectional view. The driving rollers 1*a*, 2*a* are connected to an input shaft 6 through a differential transmission mechanism 7. The input shaft 6 is provided with a thin disc 8 integrally fixed thereto and the disc 8 is provided with a plurality of recesses at its periphery within which a plurality of balls 9 having a diameter larger than the thickness of the disc 8 rotatably seat, and the right and left driving rollers 1*a*, 2*a* are connected to the input shaft 6 with the disc 8 between them being in press-contact by the pushing force of a stack of cup springs 10 which are compressed by an adjusting bolt 51 through a stopper 52.

The structure of the binder member 11 is similar in principle to that of the slider in a finished slide fastener chain being constructed with integrally combined upper piece and the lower piece in the form of triangle with a Y-shaped guide groove 12 for the scoop row. The upper piece of the binder member 11*a* is provided with a pair of guide apertures 13 and 14 along the guide groove 12 each over a length from the entrance to the binder member 11 to the position where the interengagement of the scoops of right and left stringers has been completed. One of the guide aperture 13 is longer than the other 14 at the end by a half pitch of the scoops in each of the fastener stringers. And the binder member 11 is located on the feeding side of the feed rollers 1 and 2 secured to the frame 15 integrally formed to the base member 5.

A movable base 16 capable of sliding forwardly and backwardly in the direction of the binder member 11 is interposed in a recess 17 formed in the frame 15 which opens upwardly and rearwardly. The movable base 16 is always subject to backward force exerted by a tension spring 19 located between the movable base 16 and a stand 18 on the base plate 5. A support pole 20 protrudes from the front portion of the movable base 16 and an L-shaped lever 22 having two arms each extending sidewardly and rearwardly is supported rotatably in a horizontal plane to the center portion of the movable base 16 at the bent portions thereof by means of pin 23. Further, a spring support 24 and a rotation stop 25 are provided at the front and the rear portion of said axis of the L-shaped lever on the movable base 16. The L-shaped lever 22 is urged in clockwise direction in FIG. 1 so that the rearwardly extending arm 22*b* comes into contact with rotation stop 25 by means of tension spring 26 interposed between the edge of the sidewardly extending arm 22*a* and the spring support 24. Therefore, the L-shaped lever 22 can rotate only in one direction. And the L-shaped lever 22 is provided with a stopper 27 at the underside of the sidewardly extending arm 22*a*. The stopper 27 is adapted to abut with the front or rear surface 56, 55 of the recess 28 formed in the frame 15 when the movable base 16 slides forwardly or rearwardly along the recess 17.

In its retracted position where the stopper 27 comes into contact with the rear surface 55 of the recess 28, backward movement of the movable base 16 is interruppted by way of the L-shaped lever 22 since it is prevented from rotating in a clockwise direction by the stopper 27. On the other hand, in its most forward position where the stopper 27 comes into contact with the front surface 56 of the recess 28, the L-shaped lever rotates in counterclockwise direction, as shown in FIG. 1, while it extends the tension spring 26. A support 30 having tail plate 29 is mounted pivotally for pivotal movement in a vertical plane at the front portion thereof to the support pole 20 on the movable base 16 by the pin 31. A tension spring 32 is interposed between a pin 53 of the rear portion of the support 30 and the movable base 16, and an adjusting bolt 33 is screwed into said tail plate 29 with protruding downwardly from the lower surface of the tail plate 29.

A pair of probes 34 have claws 35 extending downwardly at the front portion thereof and are mounted pivotally for pivotal movement in a horizontal plane to the support 30 at the base portion of the probe. The claws 35 of the probes 34 are located above the apertures 13 and 14 of the binder member 11 and are capable of being inserted through the guide apertures 13, 14 up to the guide groove 12 for the scoop rows. An L-shaped joint lever 36 is mounted pivotally for pivotal movement in a vertical plane to the stand 18 by means of pin 37 at the bent portion of the L-shaped joint lever 36. When a solenoid 38 located on the base plate 5 is energized, the downwardly extending arm 36*a* rotates in a clockwise direction about the pin 37 causing the frontwardly extending arm 36*b* to rotate so as to push up the tail plate 29 extending opposite the probes 34 of the support 30. In order to hold the elevated condition, the rearwardly extending arm 22*b* of the L-shaped lever 22 is inserted between the lower edge of the adjusting bolt 33 and the movable base 16. A tension spring 39 is interposed between the probes 34 so as that they are pulled inwardly towards each other.

A pair of detecting levers 40 are mounted pivotally for pivotal movement in a horizontal plane on the upper portion of pins 41 each located at the right and the left side of the frame 15 just inside the path of stringers so that they rotate in rightwardly or leftwardly. The edges of the detecting levers 40 protrude into the guide groove 12 for the scoop rows of the binder member 11 and the levers 40 are urged away by a compression spring 42 interposed between the detecting levers 40. Each claw 43 formed integrally at the leading edge of the detecting lever contacts with the scoop row of each stringer and urges it toward the lip portion of the guide groove 12. The leading portion of the claws 43 is configured so as to be inserted easily into the place where scoop or scoops is missing. These claws 43 of the detecting lever 40 are located on the up-stream-side relative to the claws 35 of the probes 34.

A pair of detectors 45 is positioned at the base portion or expanded portion of the detecting levers 40 so as to detect the movement of the detecting levers 40 and judge whether the pair of corresponding scoop rows of the stringers $f_1$, $f_2$ passing through the guide groove 12 for the scoop rows are proper or not.

The first, second and third pair of guide rollers 46, 47 and 48 are located on the frame 15 so that they guide the pair of slide fastener stringers $f_1$, $f_2$ into the guide groove 12 for the scoop rows of the binder member 11.

Operation

A pair of slide fastener stringers $f_1$ and $f_2$ each having spaced portion $S_1$ and $S_2$ where there are no scoops E in continuous rows of scoops is advanced by a pair of feed rollers 1 and 2 while binding the pair of stringers to be engaged with each other at the individual scoops thereof in the binder member 11 (refer to FIG. 1). In this instance, the claws 35 of the pair of the probes 34 are positioned immediately above the entrance points of the guide apertures 13, 14 for introducing scoops formed in the upper portion 11*a* of the binder member 11 and confront the scoops in the guide groove 12 for the scoop rows. And, the pair of detecting levers 40 come into contact with heads of scoops and urge the scoops E toward the lip side of the guide groove 12 by the expanding force of the compression spring 42.

In such condition, the stringers $f_1$ and $f_2$ are fed successively and the spaced portions $S_1$ and $S_2$ arrive at the binder member 11.

Figure 5:
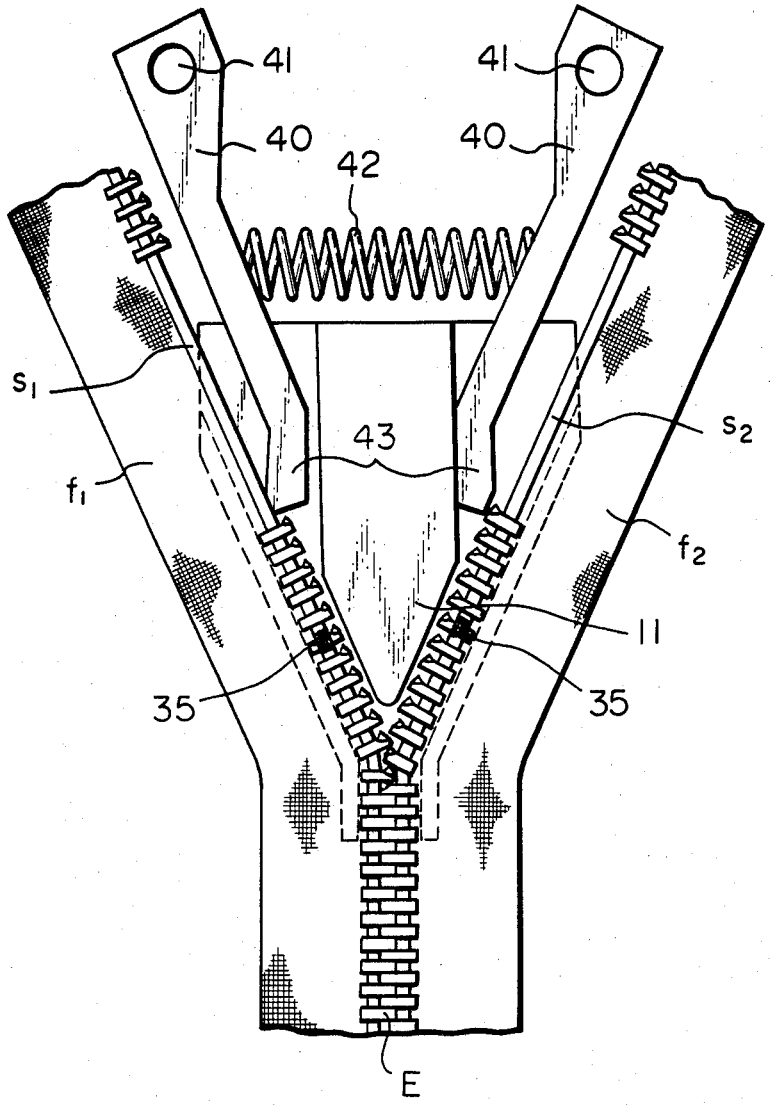
Figure 6:
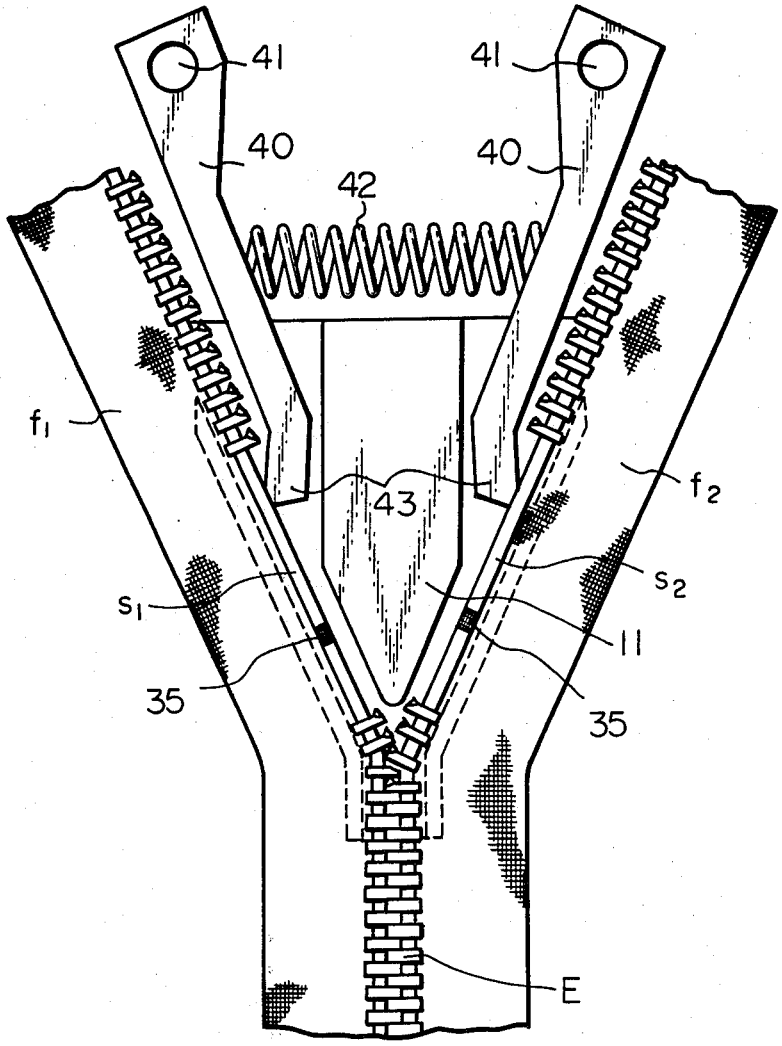
Figure 7:
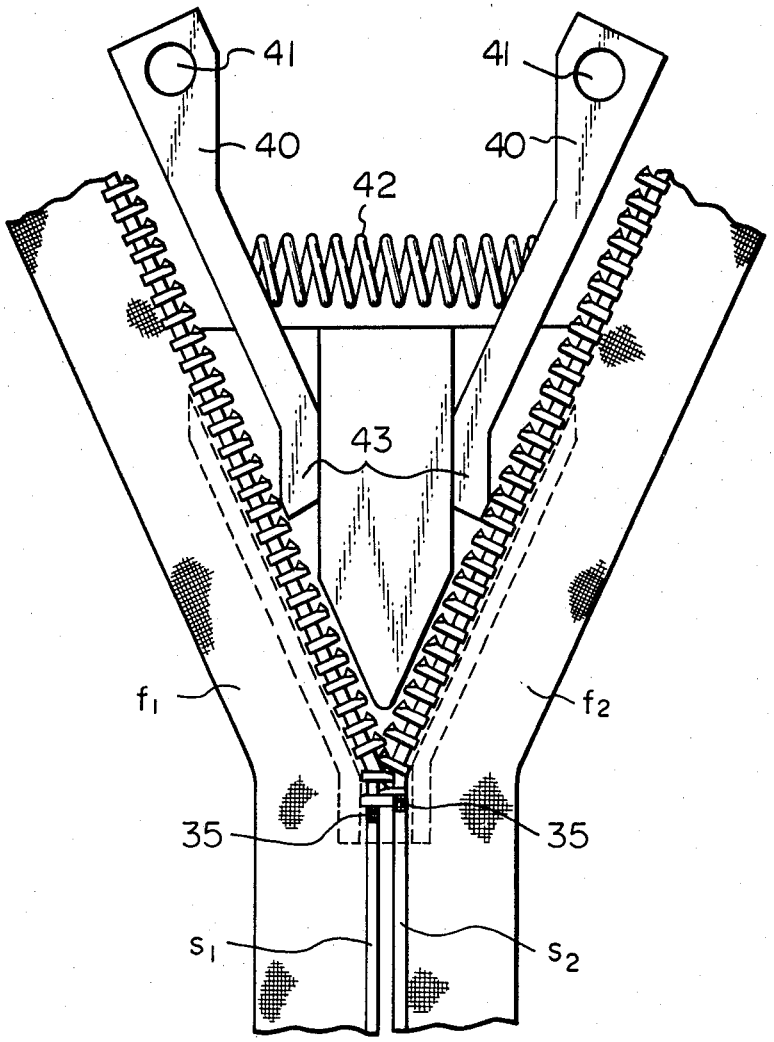
Figure 9:
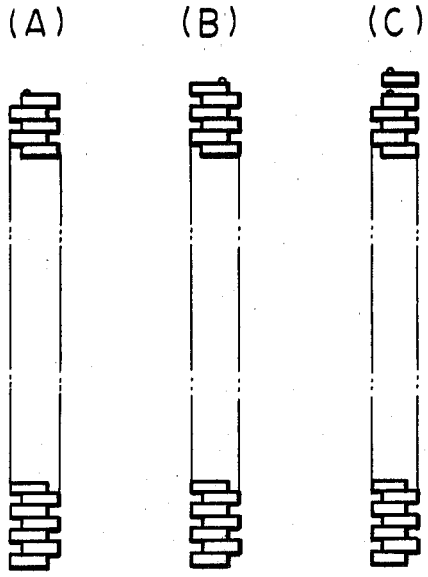
FIGS. 9(A)–(D) are elevational views of interengagement of scoop rows in various ways.

When the rear edges of the scoop rows of the stringers are in right position of alignment corresponding to that of the leading edges thereof, or as is shown in FIGS. 4–7, when one of the rear edge of the stringers $f_1$ and $f_2$, the rear edge of the left-side stringer $f_1$ in FIGS. 4–7, for example, is forwarded to relative to the rear edge of the right-side stringer $f_2$ by a half pitch of the scoop E while the leading edge of the left-side stringer $f_1$ being forwarded to relative to the leading edge of the right-side stringer $f_2$, the left-side detecting lever 40 drops into the spaced portion $S_1$ of the left-side stringer $f_1$ prior to the right-hand detecting lever 40 since the leading edge of spaced portion $S_1$ of the left-side stringer $f_1$ is forwarded to relative to that of the spaced portion $S_2$ of the right-side stringer $f_2$ by a half pitch of the scoop E (refer to FIG. 5). Then the right-side detecting lever 40 drops into the spaced section $S_2$. Although the time lag between the drop of the detecting levers 40 is very small, it is a constant value if the feeding speed of the stringers $f_1$ and $f_2$ is constant. This timing of the drop of the detecting levers 40 is sensed by the detector 45 for the detecting levers 40 and only when the timing is proper are the stringers $f_1$ and $f_2$ fed continuously. Thus, when the proper timing of the drop of the detecting levers 40, as shown in FIG. 9(A) is obtained, the detector 45 produces a signal causing the machine to continue to be operated and when the timing is not proper such case as inversion of timing, as shown in FIG. 9(B) or different timing from the predetermined timing, as shown in FIG. 9(C), or one where there is a lack of scoop or scoops in the scoop row, the detector 45 produces a signal causing the machine to stop operating. This results in the discovery of the faulty chains.

After drop of each detecting levers 40 into the spaced portions $S_1$ and $S_2$ at the predetermined timing is sensed, a timer is operated in a predetermined time and the solenoid 38 is then energized to rotate the joint lever 36 upwardly causing the tail plate 29 to push up. This results in the downward rotation of the claws 35 of the probes 34 and the insertion into the corresponding spaced sections $S_1$ and $S_2$ following to the insertion of the detecting levers 40 through the guide apertures 13 and 14 (refer to FIG. 6).

When the tail plate 29 is pushed up by the joint lever 36 and is moved away from the upper surface of the movable base 16, the L-shaped lever 22 urged by the tension spring 26 rotates so that the rearwardly extending arm **22*b* comes into contact with the stopper pin 25. The adjusting bolt 34 rides on the rearwardly extending arm 22*b* so that the probes 34 are maintained in the insertion condition, as shown in FIGS. 1 and 2**.

Figure 8:
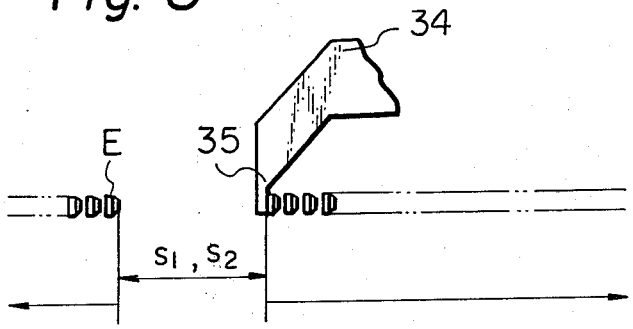
FIG. 8 is a schematic elevational view of the claws of probes and the leading edges of scoop rows in engaged condition.

In this way, when the claws 35 of the probes 34 are inserted into the spaced sections of the stringers $f_1$ and $f_2$ the claws 35 of the probes 34 comes into contact with the leading edges of the following scoop rows (refer to FIG. 8) and are advanced by the feed of the stringers $f_1$ and $f_2$ against the resistance of the tension spring 19 which urges the movable member 16 supporting the support 30 backwardly through the support pole 22 with respect to the frame 15 (refer to FIG. 2) while the claws 35 are guided by the guide apertures 13 and 14. The tension spring 39 facilitates inward movement of claws 35 of the probes 34.

When one of the claws 35 engages with the leading edge of the scoop row of one stringer $f_1$ and the other of the claws 35 does not engage with the scoop row of the other stringer $f_2$, the advancing of the stringer $f_1$ undergoes a backward tension by virtue of the engagement with the claw 35 of the probes 34, which tension in turn retards the rotational velocity of the corresponding feed roller **1*a* which is exerting a pulling force on the leading stringer $f_2$ and on the other hand, accelerates the rotational velocity of the other feed roller 2*a* which is exerting a pulling force on the trailing stringer $f_2$. Thus, the advancing velocity of the trailing stringer $f_2$ is increased while the velocity of the leading stringer $f_1$ is decreased so that the leading edge of the scoop row of the trailing stringer $f_2$ rapidly comes into contact with the claw 35 of the probe 34 in right alignment with the leading scoop to be exactly within the binder member 11. In this stage, the detecting levers 40** are pushed out of the spaced sections $S_1$ and $S_2$ by the leading edge of the scoop row and urge the scoop row outwardly again.

When the right and left claws 35 of the probes 34 arrive at the joint point of the guide groove 12, the claws 35 come out of the binder member 11. Thus, when the L-shaped lever 22 maintaining the claws in the inserted position moves forward together with the claws 35 the stopper pin 27 moves within the recess 28 in the frame 15 with the progress of the movable base 16 and comes into contact with the front surface 56 thereof causing the L-shaped lever 22 to rotate in a counterclockwise direction in FIG. 1 against force of the tension spring 26. Thereby the rearwardly extending arm **22*b* disengages from the lower edge of the adjusting bolt 33 and in turn the probes 34 under the tension spring 32 return to the first condition wherein the side of the adjusting bolt 33 contacts the side of the L-shaped lever 22. In this condition, the claws 35 disengage from the leading scoops of the scoop rows and return to the position above the guide apertures 13 and 14 of the binder member 11. At the same time, the movable base 16 is restored to the first condition by virtue of the tension spring 19. The solenoid 38** is deenergized already by this time.

The method of the present invention is, as apparent from the above-mentioned explanation about the process of the apparatus for realizing the same, characterized in that it includes the following steps; detecting spaced sections in slide fastener stringers and inserting claws engageable with leading edges of the scoop rows which follow the spaced sections into the spaced sections aligning the leading edge of the leading stringer with the leading edge of the trailing stringer by decreasing the rotational velocity of the leading stringer and increasing the rotational velocity of the trailing stringer and then pulling the claws out of the engaged position; and judging whether the engagement of the corresponding scoop rows is proper and detecting the spaced sections with alignment of the leading edge of the leading stringer with the leading edge of the trailing stringer. Thus, the proper engagement of the scoop rows of the right and left stringers is judged by successiveness of the scoops in row or the alignment of the trailing edges of the stringers. And if the proper engagement is obtained the operation is continued, and if not the operation is stopped so as to avoid the production of faulty slide fastener chains. This insures proper engagement of the scoops in combination with high speed operation of the apparatus and brings high production efficiency without producting the faulty goods.

As described above, the present invention is characterized in the combination of the detecting lever and the detector with the conventional apparatus, for example, described in the above-mentioned co-pending application. The high speed operation may be no value if faulty chains are produced. The present invention solves the problem of operating the apparatus at high speed without production of faulty chains by merely adding the simple construction described above. Further, the present method is provided effectively for realizing the same.

What is claimed is:

1. An assembling apparatus for slide fastener stringers comprising a pair of laterally disposed feed rollers for feeding a pair of laterally disposed slide fastener stringers successively each having spaced sections where there are no scoops in continuous rows of scoops; a binder member fixedly positioned on the feeding side of said feed rollers for engaging said stringers; a pair of laterally disposed claws for protruding into the spaced sections of the stringers and engaging with the leading edges of scoop rows directly following said spaced sections; a differential transmission mechanism for retarding the rotational velocity of the one of said two feed rollers which feeds the leading stringer with which one of said two claws is engaged while accelerating the rotational velocity of the other roller until the leading edges of said two stringers are aligned with each other; said claws being adapted to come out from the spaced sections of the stringers when the leading edges of the scoop rows of the stringers are aligned; characterized in that a pair of laterally disposed detecting levers are provided to protrude into the succeeding spaced sections of said stringers as they arrive and then to come out therefrom; and a detector is provided to detect the movement of the detecting lever so as to judge whether the engagement of the pair of stringers is proper and to produce either a signal to protrude the claw into the spaced section directly succeeding the detecting lever if the stringer alignment is proper or a signal to stop operating the feed roller if said alignment is not proper.

2. The assembling apparatus of claim 1 wherein the differential transmission mechanism has a structure such that a thin disc is provided integrally to the driving shaft of the feed rollers, a plurality of balls each having a diameter larger than the thickness of said disc are seated freely rotatable in recesses in said disc and the feed rollers are arranged freely rotatable on the driving shaft and are press-contacted with said balls with the disc therebetween.

3. The assembling apparatus of claim 1 or 2 wherein the probes each have a claw at one end of the probe entering a guide groove for the scoop rows and the probes pivoting around both vertical axis and horizontal axis are supported on a slider member capable of sliding along the direction of the advancement of the stringers being fed by the feed rollers and the slider member is connected to a spring exerting a pulling force on the sliding body in the direction opposite to the advancement of the stringers.

4. The assembling apparatus of claim 1 wherein the pair of detecting levers further includes a compression spring disposed therebetween to urge each scoop row on the each stringer toward the lip side of the guide groove.

5. The assembling apparatus of claim 1 wherein the detector produce a signal to continue to operate the apparatus when one of the detecting levers drops into the spaced section prior to the other detecting lever by half a pitch of the scoop.

6. The assembling apparatus of claim 1 wherein the detector produces a signal to stop operating the apparatus when one of the detecting levers does not drop into the spaced section prior to the other detecting lever by half a pitch of the scoop.

7. A method of assembling a pair of slide fastener stringers, characterized in that it comprises the steps of:

feeding a pair of laterally disposed slide fastener stringers successively each having spaced sections where there are no scoops in continuous rows of scoops;

detecting the spaced sections of the stringers and protruding into the spaced sections a claw capable of engaging with the leading edge of scoop row which directly follows the spaced sections;

aligning the leading edge of the scoop row of the leading stringer with that of the trailing stringer by means of claws which retard the velocity of the leading stringer and accelerate the velocity of the trailing stringer, and pulling the claws out of the spaced sections; and detecting the next following spaced sections of the stringers with the alignment in the leading edges of the scoop rows of the pair of stringers and determining whether the engagement of the corresponding stringers is proper or not by the difference in time of detecting the spaced portions of a pair of stringers.

* * * * *